US006603086B2

(12) United States Patent
Kawaguchi et al.

(10) Patent No.: US 6,603,086 B2
(45) Date of Patent: Aug. 5, 2003

(54) DOME SWITCH

(75) Inventors: Kenichiro Kawaguchi, Shizuoka (JP); Minoru Kubota, Shizuoka (JP); Seiji Mori, Kanagawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/073,055

(22) Filed: Feb. 12, 2002

(65) Prior Publication Data

US 2002/0130024 A1 Sep. 19, 2002

(30) Foreign Application Priority Data

Feb. 14, 2001 (JP) ..... 2001-037493

(51) Int. Cl.[7] ..... H01H 9/26

(52) U.S. Cl. ..... 200/517; 200/512; 200/513; 200/1 B

(58) Field of Search ..... 200/1 B, 4, 5 R, 200/512–517, 310, 313–317, 5 A

(56) References Cited

U.S. PATENT DOCUMENTS 4,046,975 A * 9/1977 Seeger, Jr. ..... 200/515
4,194,105 A * 3/1980 Hodges ..... 200/517
4,456,798 A * 6/1984 Iwai et al. ..... 200/5 A
5,115,108 A * 5/1992 Ogawa et al. ..... 200/1 B
5,401,922 A * 3/1995 Asta ..... 200/5 A
5,717,176 A * 2/1998 Dahlstrom ..... 200/1 B
5,824,978 A * 10/1998 Karasik et al. ..... 200/18
6,303,887 B1 * 10/2001 Ando ..... 200/512

* cited by examiner

*Primary Examiner*—Michael Friedhofer
(74) *Attorney, Agent, or Firm*—Armstrong, Westerman & Hattori, LLP

(57) ABSTRACT

A compact, thinned and water-tightened combined switch, is structured by a single switch comprising a front sheet having a domed projection which can be reversed to the back side and is provided at the back side with an electrode, an electric circuit body having an electric contact to contact with the electrode and a domed convex portion provided in the vicinity of the center of the domed projection. In operation process, firstly the projection is reversed and an electrode provided near the periphery of the convex portion contacts with the electric contact on the electric circuit body and secondly an electrode provided in the vicinity of the center of the domed convex portion contacts with the electric contact on the electric circuit body.

20 Claims, 12 Drawing Sheets

DOME SWITCH

BACKGROUND OF THE INVENTION

1. Field of the Invention

This invention relates to a dome switch having multiple switching function.

2. Description of the Related Art

A two-step switch is used frequently for a window regulator switch in a car. The first step switch operation, pushed by a finger with click feeling, makes a window glass moved and if the finger is left from the switch on the condition, the window glass is stopped. However, when pushing the switch more over the first step switch operation, the window glass moves continuously until reaching to a specified position (top end or bottom end) even if the finger is left from the switch.

Such two-step switch is usually constituted with combining at least two single switches. An example of a rocker-type combined switch, applied by the two-step switch (example of two rocker-type combined switches mounted on) is shown in FIGS. 12, 13A, 13B and 13C.

FIG. 12 is an exploded perspective view of the switch. FIGS. 13A, 13B and 13C are sectional views of one two-step switch for describing its actions.

A switch-operating portion 82, mounted on a cover 81, is pivoted on a shaft 83 capably of rocking. The switch-operating portion 82 is provided inside thereof with cam portions 82*a*, 82*a*' for moving pins 82*b*, 82*b*' up and down by rocking the switch-operating portion 82. The switch-operating portion 82 is provided at the back side thereof near the cam portions 82*a*, 82*a*' with a concave cam portion 82*c* for returning the switch-operating portion 82 to a neutral position (position shown in FIG. 13A), which is in a condition of OFF (electrically nonconductive condition) on single switches 87, 87', by combined action of the concave cam 82, a restraining pin 84 and a spring 84*a* when an operator finger is left from the switch-operating portion 82.

An electric circuit body 85, covered by a cover 81, is generally provided with an electric circuit (not shown) and an electric contact. A rubber contact 86 is fixed by a rubber contact locking hole 85*a* of the electric circuit body and a locking piece 86*a* of the rubber contact 86.

When single switches 87, 87', 88 and 88', mounted on positions corresponding to contacts for rubber contacts on the electric circuit body 86, are pushed and deformed, electrodes provided at the side of the electric circuit body 85 on the single switches contact respectively with the contacts of the electric circuit body 85 and then the switches turn ON to be electric conductive.

The single switches 87 (87') and 88 (88') have deferent stroke length to contact with the electric contacts.

When an operator pushes an arrow portion of the switch-operating portion 82, shown in FIG. 13A, the switch-operating portion 82 sways to be in a condition shown in FIG. 2B. In the condition, a pin 82*b* is pushed down by the cam 82*a* and a single switch 87 is pushed so that a first contact (not shown) in the electric circuit body 85 turns ON to be electric conductive. The operator can perceive the single switch 87 turning ON by operation feeling of deformation of a rubber portion of the single switch 87.

When the operator pushes down more the switch-operating portion 82, the switch-operating portion 82 sways more to be in a condition shown in FIG. 13C. In the condition, not only the single switch 87 but also the single switch 88 turn ON to be electric conductive.

After that, when the operator moves the finger away from the switch-operating portion 82, the switch-operating portion 82 returns to a neutral position (position shown in FIG. 13A and the single switches 87, 88 turn OFF.

Thus, operating a left side (an arrow portion) of the switch-operating portion 82, three conditions which are both single switches 87, 88 OFF (OFF+OFF), only single switch 87 ON (ON+OFF) and both single switches 87, 88 ON (ON+ON) can be given to control various operations with relays or control circuits sensing conditions of single switches.

Describing above the example of operating the left side in a figure of the switch-operating portion 82, in case of operating a right side of the switch-operating portion 82, firstly a single switch 87' turns ON and secondly a single switch 88' turns ON.

In such two-step switch, a rubber contact locking piece projects from a rear surface of an electric circuit body to be an obstacle to mount the electric circuit body on a surface in an equipment with a double-side adhesive tape or the like. Therefore, getting watertight structure is hindered and also getting thinner thickness of a single switch portion becomes difficult. Two respective single switches are required to have three conditions which are OFF+OFF, ON+OFF and ON+ON so that miniaturization of the single switch is difficult.

In a process from the first step to the second step, a reaction force by compressive elasticity of a rubber portion of the single switch 87 is relative strong to be difficult to sense securely the operation of the switch-operating portion by only operating feeling when the two single switches turn ON.

Objects to be Solved

This invention has been accomplished to overcome the above drawbacks and an object of this invention is to provide a switch having multiple switching functions to be easily miniaturized, watertight and compact.

SUMMARY OF THE INVENTION

How to Attain the Object

In order to attain the objects, according to an aspect of this invention, there is provided a dome switch including a single switch comprising a front sheet having a domed projection projecting outside, being reversed to a back side and provided at the back side with an electrode; an electric circuit body having an electric contact to contact with an electrode provided on the domed projection when the domed projection is turned over; and a domed convex portion provided near the center of the domed projection. In process of pushing the convex portion, firstly the projection is turned over and an electrode provided near the periphery of the convex portion at the back side of the front sheet contacts with the electric contact provided on the electric circuit body and secondly an electrode provided near the center of the domed convex portion at the back side of the front sheet contacts with the electric contact provided on said electric circuit body.

In the above-mentioned structure, the dome switch can be thinner and more compact and water-tighten easily. Furthermore, any locking piece provided on a back side of the electric circuit body is not required, then the dome switch can be mounted easily on a surface of an equipment.

According to an other aspect of the invention, there is provided the dome switch which comprises the dome switch as referred to above, wherein the domed convex portion has a structure capable to turn over to the back side of the front sheet. In the above-mentioned structure, an operator can confirm an action of a second step switch by feeling and then more secure operation can be done.

According to further aspect of the invention, there is provided the dome switch which comprises the dome switch as referred to above, and has a plurality of the single switches. In the above-mentioned structure, more complicated function and operation can be given to keep compact size.

According to a more other aspect of the invention, there is provided the dome switch which comprises the dome switch as referred to above all, and is provided between the front sheet and the electric circuit body with a spacer sheet formed with a throughhole for ensuring contact between the electrode at the back side of the front sheet and the electric contact of the electric circuit body in the single switch to prevent deformation of the front sheet.

In the above-mentioned structure, deformation of the front sheet is prevented for a lot of repeat operation so that durability and reliability of the switch are extremely improved.

According to a further aspect of the invention, there is provided the dome switch which comprises the dome switch as referred to above, wherein the spacer sheet functions to provide a stroke distance for the projection and the convex portion.

In the above-mentioned structure, a depth of the throughhole can be increased and then the stroke distance for the projection can be increased. Thus, the spacer sheet functions to provide a large stroke distance for the projection.

According to a further aspect of the invention, there is provided the dome switch which comprises the dome switch as referred to above, wherein the spacer sheet includes multi-layered sheets and a top layered spacer sheet at the front sheet side is formed thinner than other under layered spacer sheet for fine adjustment of the stroke distance.

In the above-mentioned structure, total thickness of the spacer sheets can be adjusted by number of layers and the stroke distance of the projection can be easily adjusted and fine adjusting can be done.

Further, forming a spacer sheet with multi-layered sheets, stiffness of the spacer sheet becomes more flexible than that of a single-layered sheet.

According to a further aspect of the invention, there is provided the dome switch which comprises the dome switch as referred to above, wherein a diameter of the throughhole of the top layered spacer sheet is formed larger than or equal to a diameter of the projection, and a diameter of the throughhole of the under layered sheet is formed larger than or equal to the diameter of the top layered sheet.

In the above-mentioned structure, deformation of the front sheet, around the throughhole, by turning the projection over can be minimized and then durability and reliability of the front sheet are extremely improved.

According to a further aspect of the invention, there is provided the dome switch which comprises the dome switch as referred to above; a plurality of the single switches; a spacer sheet being formed in positions corresponding to the plurality of the single switches with throughholes for ensuring contact between the electrode at back side of the front sheet and the electric contact of the electric circuit body in each of the single switches to prevent the front sheet from deformation, and located between the front sheet and the electric circuit body; and an air communicating portion for communicating the throughholes in the spacer sheet with each other.

In the above-mentioned structure, various operations with the plurality of single switches can be done and increasing air pressure in a corresponding throughhole of the spacer sheet by operating a single switch can be released to other throughhole for other single switch. Therefore, deterioration of operation feeling and water-tightness by air pressure increasing can be prevented and durability of the switch can be improved.

According to a further aspect of the invention, there is provided the dome switch which comprises the dome switch as referred to above, wherein the spacer sheet includes multi-layered sheets and the air communicating portion is provided on the spacer sheet other than a top layered spacer sheet at the front sheet side.

In the above-mentioned structure, deterioration of the front sheet by an edge of the air communicating portion can be prevented and durability and reliability of the switch can be improved.

According to a further aspect of the invention, there is provided the dome switch which comprises the dome switch as referred to above, an adhesive layer provided on a rear surface of the electric circuit body for fixing the dome switch on a mounting device, and an air vent through the electric circuit body and the adhesive layer being communicated with the air communicating portion.

In the above-mentioned structure, providing an airtight air chamber on an area, corresponding to the air vent of the adhesive layer, of the mounting device mounted with the dome switch, deterioration of operation feeling on a single switch can be prevented almost completely.

According to a further aspect of the invention, there is provided the dome switch which comprises the dome switch as referred to above, wherein a light emitting diode is mounted on a front sheet side surface of the electric circuit body, wherein the spacer sheet is provided with a light guide portion for receiving said light emitting diode and guiding a light of the diode to the front sheet, and wherein the front sheet has a light transmissible area which corresponds to said light guide portion and illuminated by the light emitting diode (LED is short form after this).

In the above-mentioned structure, an LED mounted on an electric circuit body in a dome switch assembly can be received in a light guiding portion of a spacer sheet and then LED can be mounted on a front sheet side surface of the electric circuit body. A light, emitted by the LED mounted on an electric circuit body, is guided through the light guiding portion of the spacer sheet and then a lighting area of the front sheet is illuminated. The light through the lighting area makes lighting area look just as if the lighting area emits by itself.

According to a further aspect of the invention, there is provided the dome switch which comprises the dome switch as referred to above, wherein a light diffusing device is provided between the light guiding portion and the lighting area.

In the above-mentioned structure, a lighting area of a front sheet is illuminated by diffused light by a light diffusing device when an LED is emitted. Therefore, partial lighting (non-uniformity) is prevented so that high grade looking can be given.

According to a further aspect of the invention, there is provided the dome switch which comprises the dome switch as referred to above, wherein a chip-type component is mounted on a front sheet side surface of the electric circuit body and the spacer sheet has a chip type component receiving section for receiving the chip type component.

In the above-mentioned structure, a chip-type component can be mounted on a front sheet side surface of the electric circuit body.

According to a further aspect of the invention, there is provided the dome switch which comprises the dome switch as referred to above, wherein the front sheet has a projection in a location corresponding to the chip type component receiving section of the spacer sheet.

In the above-mentioned structure, a chip-type component, higher than a thickness of a spacer sheet, can be mounted if a chip-type component is mounted on a front sheet side surface of the electric circuit body. Therefore, a thicker spacer sheet affecting operating feeling of a single switch is not required to mount a higher chip type component.

According to a further aspect of the invention, there is provided the dome switch which comprises the dome switch as referred to above all, wherein the electric circuit body is provided, on a rear surface thereof, with an adhesive layer for fixing a dome switch on a mounting device and a chip-type component is mounted on the rear surface of the electric circuit body and the adhesive layer is provided with a chip-type component receiving section corresponding to the chip component.

In the above-mentioned structure, a chip-type component can be mounted on a rear surface of the electric circuit body. Providing a receiving recess in a location corresponding to the chip-type component on the mounting member, flat looking mounting can be done.

According to a further aspect of the invention, there is provided the dome switch which comprises the dome switch as referred to above, wherein the electric circuit body is provide therethrough with an air vent communicating from a space, formed with a domed projection and the electric circuit body, to a rear surface of the electric circuit body.

In the above-mentioned structure, deterioration of operation feeling on a single switch by air in a space, formed with a domed projection and the electric circuit body, can be prevented and the switch can be operated securely.

According to a further aspect of the invention, there is provided the dome switch which comprises the dome switch as referred to above, wherein the electric circuit body is provided, on a rear surface thereof, with an adhesive layer having an air vent corresponding to the air vent of the electric circuit body for fixing a dome switch on a mounting device.

In the above-mentioned structure, a chip type component can be mounted on the rear surface of the electric circuit body in case of a dome switch with an adhesive layer.

According to a further aspect of the invention, there is provided the dome switch which comprises the dome switch as referred to above, and an operating device having an loading portion which is smaller than the convex portion of the single switch for pushing the convex portion and an operating portion which is larger than the convex portion.

In the above-mentioned structure, without deterioration of operation feeling on the single switch, the switch can be operated easily by not only a fingertip, but also other body part or by fingers worn in gloves.

According to a further aspect of this invention, there is provided a rocker-type combined switch comprising a rocker-type operating portion having two symmetrical shaped pushing portions at both ends thereof, a rocker fulcrum portion supporting the rocker-type operating portion as a rocker fulcrum, and a dome switch having at least one single switch, described in all above, respectively under said two pushing portions, and an actuating pin for actuating respectively each convex portion of the at least one single switch by rocking motion of the rocker-type operating portion, wherein a loading portion of the actuating pin, abutting respectively on each convex portion of the single switches, is smaller than each corresponding convex portion of the single switches and the pushing portions are larger than convex portions of the single switches. Therefore, operating a switch is easy and number of components is minimized and designing an electric circuit body is easy and then a compact and watertight switch can be given easily.

According to a further aspect of this invention, there is provided the rocker-type combined switch which comprises the rocker-type combined switch as referred to above, wherein moving direction of the actuating pin for pushing a convex portion of a single switch is the same as stroke direction of the convex portion of the single switch. Therefore, operating a switch can be done very securely.

A dome switch according to this invention is structured by a single switch comprising a front sheet having a domed projection which projects outside and can turn over to the back side and is provided at the back side thereof with an electrode; an electric circuit body having an electric contact contacting with the electrode provided at the back side of the projection when the domed projection is turned over; and a domed convex portion provided near the center of the domed projection. In process of pushing the convex portion, firstly the projection turns over and an electrode provided near the periphery of the convex portion at the back side of the front sheet contacts with the electric contact provided on the electric circuit body and secondly an electrode provided near the center of the domed convex portion at the back side of the front sheet contacts with the electric contact provided on the electric circuit body. Therefore, the dome switch has a simple and reliable structure and is easily miniaturized, water-tightened and thinned, can be operated securely with click feeling.

Although the present invention has been fully described by way of examples with reference to the accompanying drawings, it is to be noted that various change and modifications can be made with the scope of the present invention.

DESCRIPTION OF THE PREFERRED EMBODIMENT

Figure 1A:
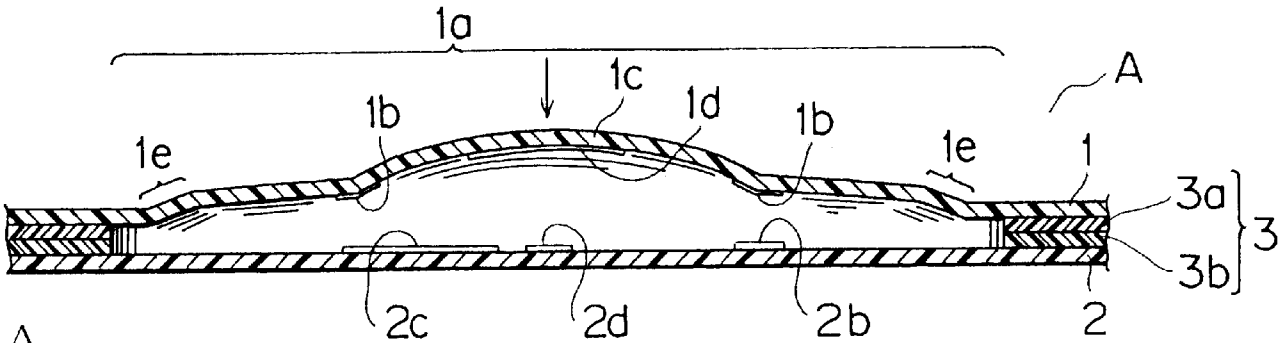
FIG. 1A is a sectional view of an embodiment of a dome switch according to the invention, showing a condition before operation.
Figure 1B:
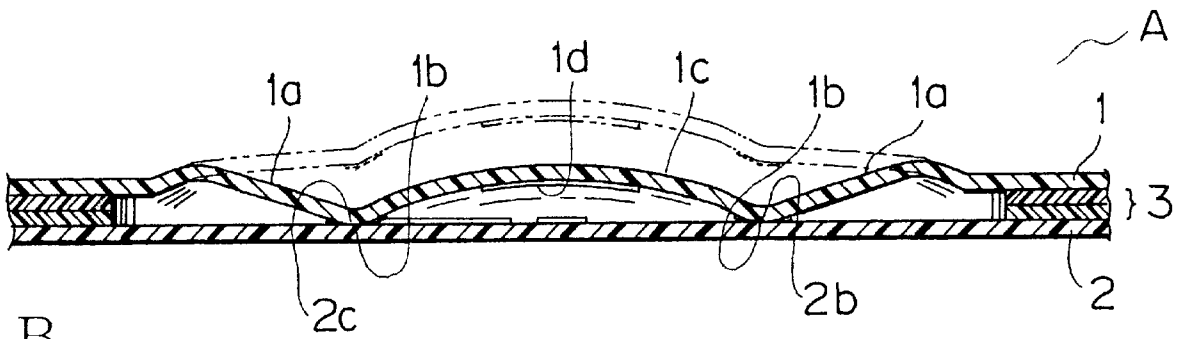
FIG. 1B is a sectional view of the dome switch in FIG. 1A, showing a first step condition of operation.
Figure 1C:
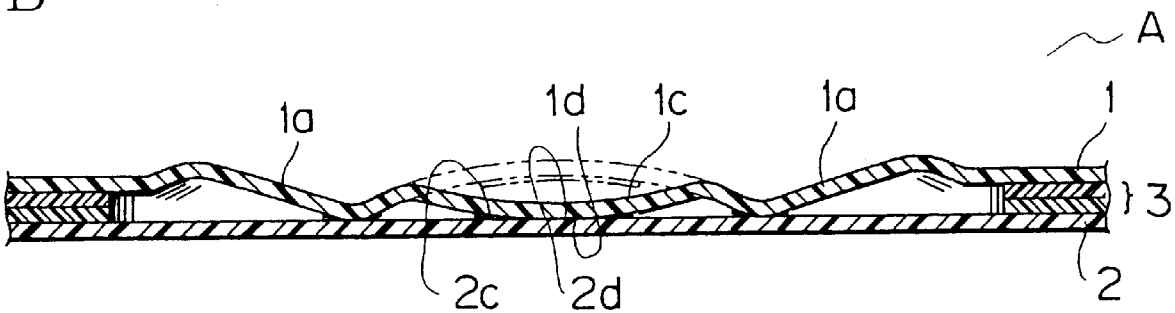
FIG. 1C is a sectional view of the dome switch in FIG. 1A, showing a second step condition of operation.

A rocker-type combined switch of an embodiment according to this invention will be described with reference to the attached drawings. FIGS. 1A, 1B and 1C are sectional conceptual drawings, showing action of a single switch A.

In FIG. 1A, mark 1 is a front sheet (made of polyethylene terephthalate, PET, in this embodiment) having a domed projection 1*a*, projecting outside, capable of turning over to a back side and provided at the back side with an electrode. The single switch A is provided with an electric circuit body 2 (made of a flexible printed circuit, FPC, in this embodiment, but not limited FPC in this invention) having electrical contacts 2*b*, 2*c* to contact with an electrode 1*b* provided at the back side of the domed projection 1*a* when the domed projection 1*a* (diameter is 14 mm) is turned over. The domed projection 1*a* is provided concentrically in the center thereof with other domed convex portion 1*c* (diameter is 7 mm).

Figure 2A:
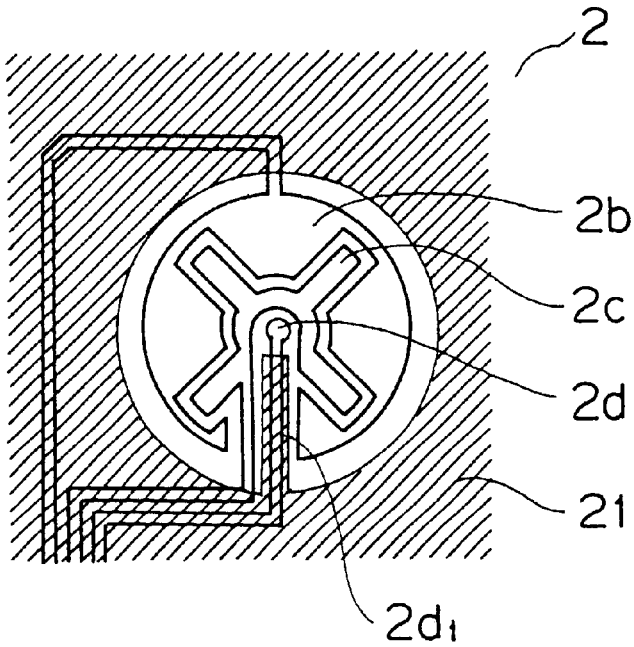
FIG. 2A is a drawing of an electric contact pattern of an electric circuit body of a single switch in a dome switch according to the invention.

An electric contact pattern of the electric circuit body 2 is shown in FIG. 2A. The electric contacts are provided in order from outside with 2*b*, 2*c* and 2*d*. The electric contact 2*c* is formed into C-shape having X-shape extension in directions of 45 degree, 135 degree, 225 degree and 315 degree in the drawing. On the other hand, the electric contact 2*b* is formed into C-shape having inward projections in directions of 0 degree, 90 degree, 180 degree and 270 degree not to contact with the X-shape extension of the electric contact 2*c*.

Figure 2B:
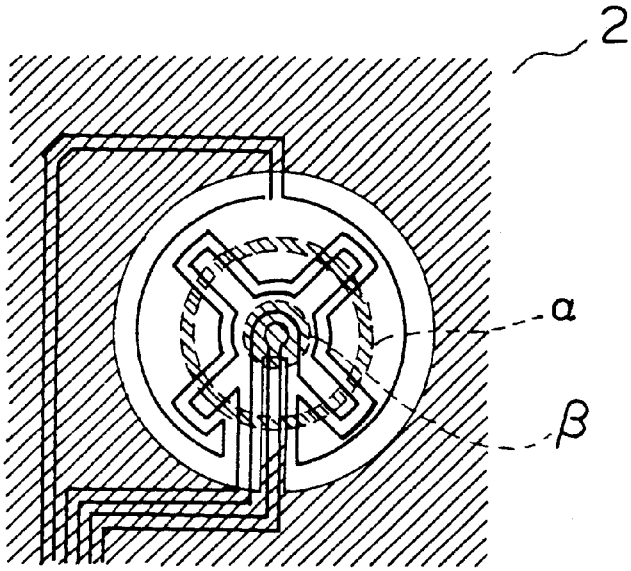
FIG. 2B is a drawing of an electric contact pattern of an electric circuit body in FIG. 2A, showing area contacted with electrodes.

In process of being pushed the convex portion 1*c* by operator, shown in FIG. 1B, firstly the projection 1*a* is turned over to put the electrode 1*b* provided near the periphery of the convex portion 1*c* at the back side of the front sheet in contact with the electric contacts 2*b*, 2*c* and then the electric contacts 2*b* and 2*c* are electrically connected (the first step; the contacting area with the electrode 1*b* is shown by area alpha in FIG. 2B).

To prevent contacting a center electric contact 2*d* and the electrode 1*b* mutually in this step, a lead portion 2*d*1 of the electric contact 2*d* is covered with a nonconductive mask 21 (hatching area shown in FIG. 2A).

In the structure which the electric contacts 2*b* and 2*c* are formed into correspondingly staggered extensions with 45 degree shifting as mentioned above, the electric contacts 2*b* and 2*c* are electrically connected even if turning over of the projection 1*a* is turned over incompletely and partially when an operation by an operator is incomplete and the convex portion 1*c* is pushed obliquely not straightly from right overhead.

Secondary, as shown in FIG. 1C, an electrode 1*d* provided near the center of the domed convex portion 1*c* at the back side of the front sheet contacts with the electric contacts 2*d* and 2*c* of the electric circuit body (the second step; the contacting area is shown by area beta in FIG. 2B). Therefore, the electric contacts 2*d* and 2*c* are electrically connected and simultaneously the electric contacts 2*c* and 2*b* are electrically connected as mentioned above. Then, all electric contacts 2*b*, 2*c* and 2*d* are electrically connected to each other.

Thus, a single switch A is a single switch but also is a combined switch having three contacting modes.

A material and a thickness of the front sheet and figures of the domed projection 1*a* and the domed convex portion 1*c* may be selected so that firstly the electrode 1*b* contacts with the electric contact 2*b* and secondary the electrode 1*d* contacts with the electric contact 2*d* and switch operation is finished in the process of pushing the single switch A as mentioned above and the shape of the single switch A can return immediately to the shape shown in FIG. 1A when pushing load on the single switch A is removed. In this embodiment, the domed projection 1*a* and the domed convex portion 1*c* are formed on hot press.

In general, The domed projection 1*a* and the domed convex portion 1*c* of the single switch A are disposed concentrically. Preferably, the diameter of the domed projection 1*a* may be 8~25 mm and the diameter of the domed convex portion 1*c* may be 4~16 mm, assuming the operation done by an operator's fingertip. The diameters can be larger or smaller when any devices improving operation may be used in combination, later described.

The single switch A is provided between the front sheet 1 and the electric circuit body 2 with a spacer sheet 3 formed with a throughhole for not interrupting contact between the electrode at the back side of said front sheet in a single switch and the electric contact of said electric circuit body to prevent deformation of the front sheet 1. The spacer sheet 3 also performs to provide a stroke distance of the projection 1*a* and the convex portion 1*c*. In this embodiment, the spacer sheet 3 is structured with a single layer 3*a* and a plurality of single layers 3*b* so that the spacer sheet 3 has high flexibility as a whole and can be bent into a required shape.

In this embodiment, not only the domed projection 1*a* but also the domed convex portion 1*c* is turned over. Therefore, an operator can feel securely three conditions of OFF+OFF, ON+OFF and ON+ON in the two steps switch with each click feeling on respective turning over.

For evaluating operation feeling of the single switch A physically and objectively, displacement (stroke) of the center on the convex portion 1*c* is measured when the center of the convex portion 1*c* is loaded with 5 mm/min speed by a round pin having a load cell (pin diameter is a half of the diameter of the convex portion 1*c*). A result on relation of the load and the displacement is shown in FIG. 3 (solid line shows a result on process of pushing the single switch A with the load and dotted line shows a result on process of removing the load in FIG. 3).

Figure 3:
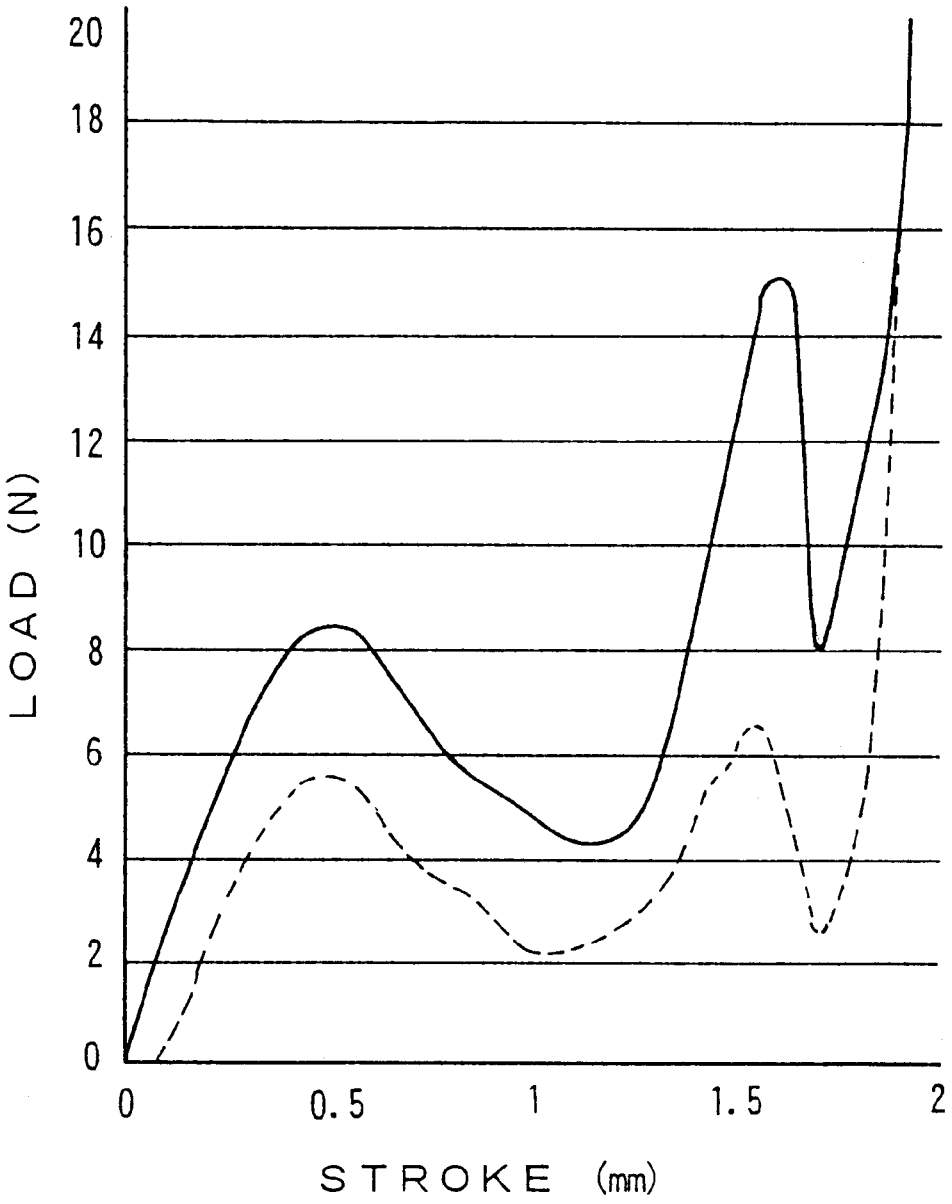
FIG. 3 is a graph, showing a result of measuring a relation between a load and a displacement (stroke) of the center of the convex portion in a single switch A in a dome switch according to the invention.

In FIG. 3, the load is increasing gradually until the displacement of the center on the convex portion 1*c* reaches 0.5 mm and the load is decreasing between 0.5 mm–1 mm (the first step, refer FIG. 1B) so that click feeling is produced clearly. Thereafter, the load is increasing until the displacement reaches 1 mm–1.5 mm and the load is decreasing rapidly until the displacement reaches 1.7 mm (the second step, refer FIG. 1C) so that a second click feeling is produced clearly.

Furthermore, twice click feelings are produced clearly in removing load process as shown with dotted line so that the second step operation is finished and then the first step switch condition can be securely kept again.

The single switch A by a dome switch according to the invention has a very simple thin structure with extremely small numbers of parts. Therefore, possibility of a malfunction is very low and in spite of operating in only 2 mm stroke (effective stroke is 1.7 mm in operation), twice clear click feelings are produced in the stroke so that secure operation can be done.

Regarding a dome switch according to the invention, shapes of the domed projection and the domed convex portion of the single switch are not limited as an example shown in FIG. 1.

Figure 4A:
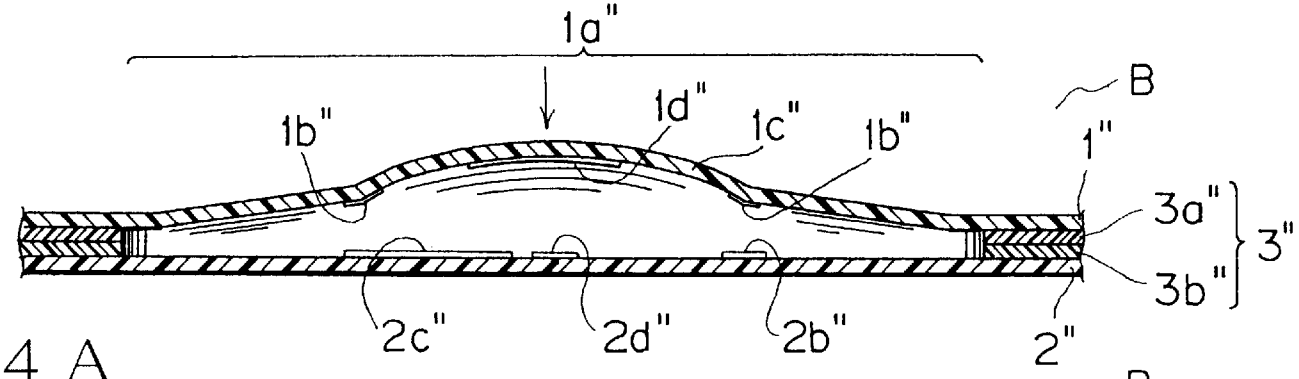
FIG. 4A is a sectional view of a dome switch having a single switch B according to the invention, showing a condition before operation.
Figure 4B:
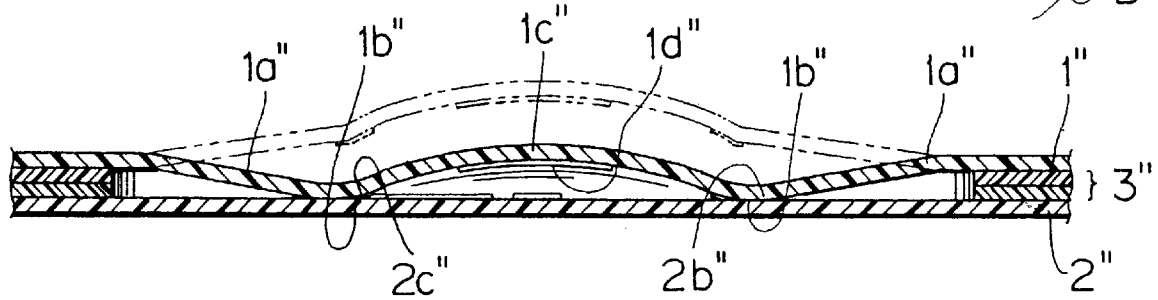
FIG. 4B is a sectional view of the dome switch in FIG. 4A, showing a first step condition of operation.
Figure 4C:
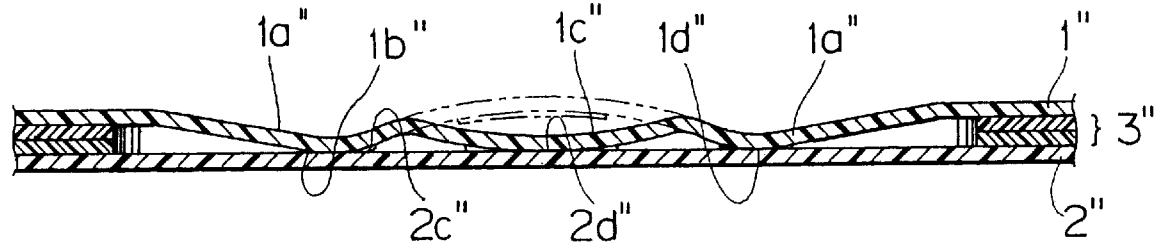
FIG. 4C is a sectional view of the dome switch in FIG. 4A, showing a second step condition of operation.

An action of the other dome switch (providing a single switch B) according to other embodiment of the invention is shown in FIGS. 4A–4C.

A domed projection 1*a*" of the single switch B shown in drawings is not provided with a steep slant portion le provided near an edge of the domed projection 1*b* on the single switch A shown in FIG. 1A, but formed uniformly with a slant continuous to the domed convex portion. This single switch B can have three modes of OFF+OFF, ON+OFF and ON+ON as shown in FIGS. 4A–4C, similarly to the single switch A. Not only the domed projection 1*a*" but also the domed convex portion 1*c*" is turned over and the single switch B returns immediately to a condition shown in FIG. 4A when switch operation is finished and a load on the single switch B is removed. (Marks with " in the drawings correspond to marks without " in FIG. 1.)

Preferably, a plurality of above single switches may be provided in a dome switch according to the invention so that the dome switch can have more complicated functions and operations than a dome switch with one single switch. Preferably, a conventional dome switch (single switch) having only normal ON-OFF function and other general switch and controller may be combined as other embodiment according to the invention.

Figure 5:
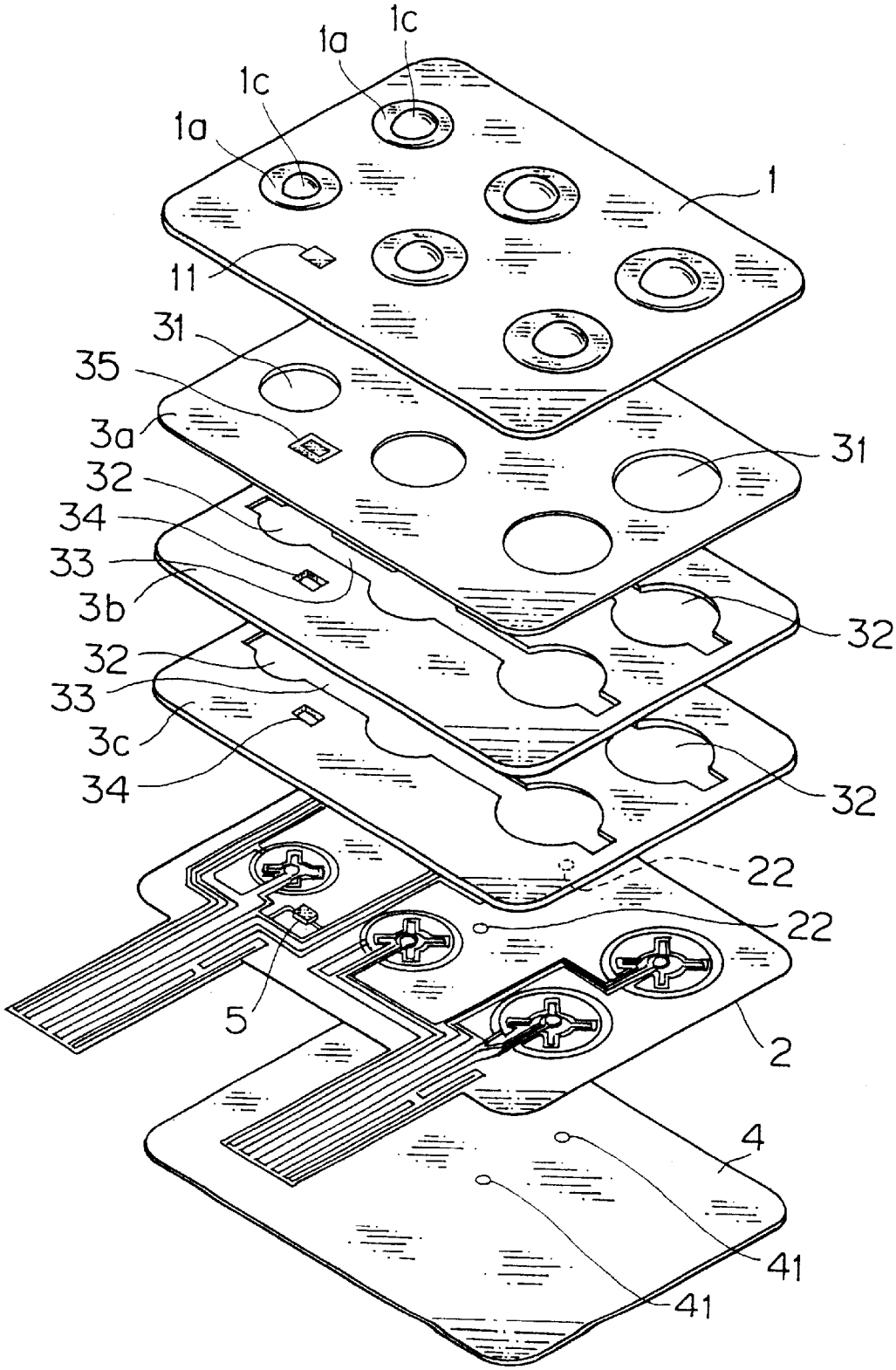
FIG. 5 is an exploded perspective view of an example of a dome switch having a plurality of single switches A.

An example of a dome switch having a plurality of above single switches A is shown in FIG. 5 (an exploded perspective view).

The front sheet 1 is provided with a plurality of the domed projections la and a plurality of the domed convex portions 1*c* (six pairs in this example).

Mark 3 shows a spacer sheet structured with multiple layers by single layer 3*a*–3*c* (three layers in this example). Each single layer 3*a*–3*c* has adhesive layers on the both surfaces to be combined mutually by stacking and to be combined water-tightly with the front sheet 1 and the electric circuit body 2 (FPC).

The top layered spacer sheet (single layer) 3*a* at side of the front sheet 1 of the spacer sheet is thinner than other under layered spacer sheets (single layer) 3*b* and 3*c* for adjusting a stroke distance of the single switch A. The thickness of the top spacer sheet can be adjusted to operate the single switch A in the best condition. The top layered spacer sheet (single layer) 3*a* performs to prevent deformation of the front sheet 1. In this example, a spacer sheet (single layer) 3*b* and a spacer sheet (single layer) 3*c* is the same.

A diameter of a throughhole 31 in the above top layered spacer sheet (single layer) 3*a* is formed 1 mm larger than a diameter of the projection 1*a*. Diameters of throughholes 32 in other under layered spacer sheets (single layer) 3*b*, 3*c* are formed 1 mm larger than the diameter of the throughhole 31 in the top layered spacer sheet (single layer) 3*a*.

In such structure, deformation of the front sheet 1 around the throughhole 31 by turning over the projection 1*a* can be minimized and then durability and reliability of the single switch can be extremely improved.

The under layered spacer sheets 3*b* and 3*c* are provided with an air communicating portion 33 for communicating throughholes 32 in the spacer sheet mutually. The air communicating portion 33 can release increased air pressure in a throughhole by operating a single switch to other throughhole. Therefore, operation feeling and operation reliability can be improved and deterioration of water-tightness and air-tightness can be prevented. Unexpected stress on the front sheet by increased air pressure in operation can be prevented and then durability of the switch can be improved. Furthermore, not providing such air communicating portion between the throughholes 31 of the top layered spacer sheet 3*a* prevents ununiform stress on an operated single switch by an edge of the air communicating portion and then durability of the switch is improved.

The electric circuit body is provided at the back side (mounting side) with an adhesive layer such as glue to be mounted on a mounting device easily and water-tightly. The adhesive layer is usually protected by released paper or releasing film before mounting.

In this embodiment, the electric circuit body 2 and the adhesive layer 4 are respectively provided therethrough with air vents 22 and 41 being communicated with the air communicating portion 33 provided in the spacer sheets 3*b* and 3*c*.

The air vents 22, 41 completely solve problems by increasing air pressure in the throughholes in operation of the single switch A. Providing a relative large air chamber on a mounting area of the mounting device (not shown) which is air-tight when the dome switch is mounted, the air chamber can be used as an air buffer for air pressure changing.

For a dome switch having a plurality of single switches, an air vent is preferably provided through from an air communicating portion of a spacer sheet to a back side of an electric circuit body (or back side of an adhesive layer), as mentioned above. For a dome switch having only one single switch, an air vent may be provided directly from an air space formed by a domed projection and an electric circuit body to a back side of an electric circuit body (or back side of an adhesive layer) so that problems by increasing air pressure in operation of the single switch can be solved with an air chamber provided on a mounting device as mentioned above.

An electric circuit body in a dome switch according to this invention can be provided with other than a switch circuit, for example, a light emitting device such as LED (Light Emitting Diode), a display device such as LCD (Liquid Crystal Display) or other chip-type parts such as ICs, LSI or resistances unless switch function is affected.

In an embodiment shown in FIG. 5, an LED 5 is mounted on a front sheet side of an electric circuit body 2.

Spacer sheets 3*b* and 3*c* are provided with a light guide portion 34 for receiving the LED 5 and for guiding the light to the front sheet 1. A top layered spacer sheet 3*a* is provided in area corresponding to the light guide portion 34 with a light diffusing device 35, such as white painting, for diffusing the light from a light emitting diode.

The light diffusing device 35 is provided optionally. When a light diffusing device 35 is not provided, the spacer sheet 3*a* may be provided with the same light guide portion 34 provided in the spacer sheets 3*b*, 3*c*.

Furthermore, the front sheet 1 is provided in an area, illuminated by a light emitting diode, corresponding to the light guide portion 34 with a light transmissible portion 11.

In the above-mentioned structure, a light emitting LED 5 makes lighting area look just as if the lighting area emits by itself. In case of providing a light diffusing device, ununiform lighting is provided so that visibility of the lighting is improved. The light guide portion and the lighting area are rectangular shape in the embodiment, but other shapes can be used.

In the embodiment shown in FIG. 5, the electric circuit body 2 is not provided therethrough with an air vent 22 and then the dome switch is watertight itself and requires no air chamber which is required on a mounting device shown in FIG. 4A.

Figure 6:
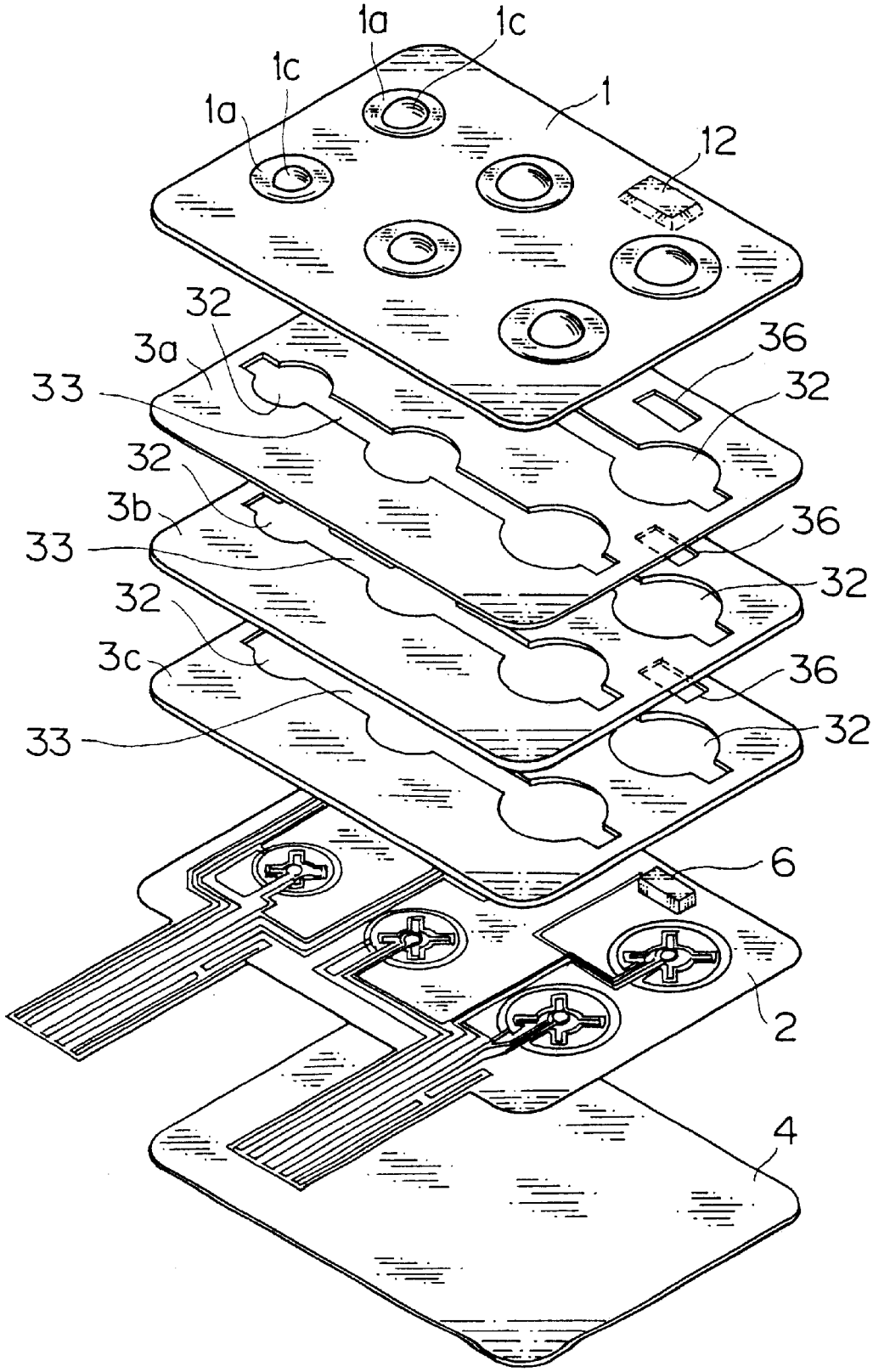
FIG. 6 is an exploded perspective view of an example of a dome switch having chip-type components mounted on a front sheet side of an electric circuit body.

An example of an electric circuit body 2 provided on the front sheet side with a chip-type part is shown in FIG. 6.

This example is provided with a chip-type part in place of a light emitting diode in the dome switch shown in FIG. 5 and the top layered spacer sheet 3*a* is provide with an air communicating portion 33 communicating mutually throughholes 32 similarly to under layered spacer sheets 3*b* and 3*c*, differing from the dome switch in FIG. 5 (marks of common parts are the same in FIG. 5).

The spacer sheets 3*a*–3*c* are provided therethrough at the positions corresponding to chip-type components 6 mounted on the front sheet side of the electric circuit body 2 with chip-type component receiving portions 36.

In this example, mounting height of the chip-type components 6 is larger than the thickness of the spacer sheet so that the front sheet is provided with projections 12 having enough height to receive the chip-type components 6 (the projections 12 are not required if the height of the chip-type components 6 is lower). The projections 12 are enough for receiving chip-type components 6, then is not required to be turned over similarly to the domed projection 1*a* or the domed convex portion 1*c*.

Furthermore, chip-type components can be mounted not only on the front sheet side but also on a back side of the electric circuit body 2.

Figure 7:
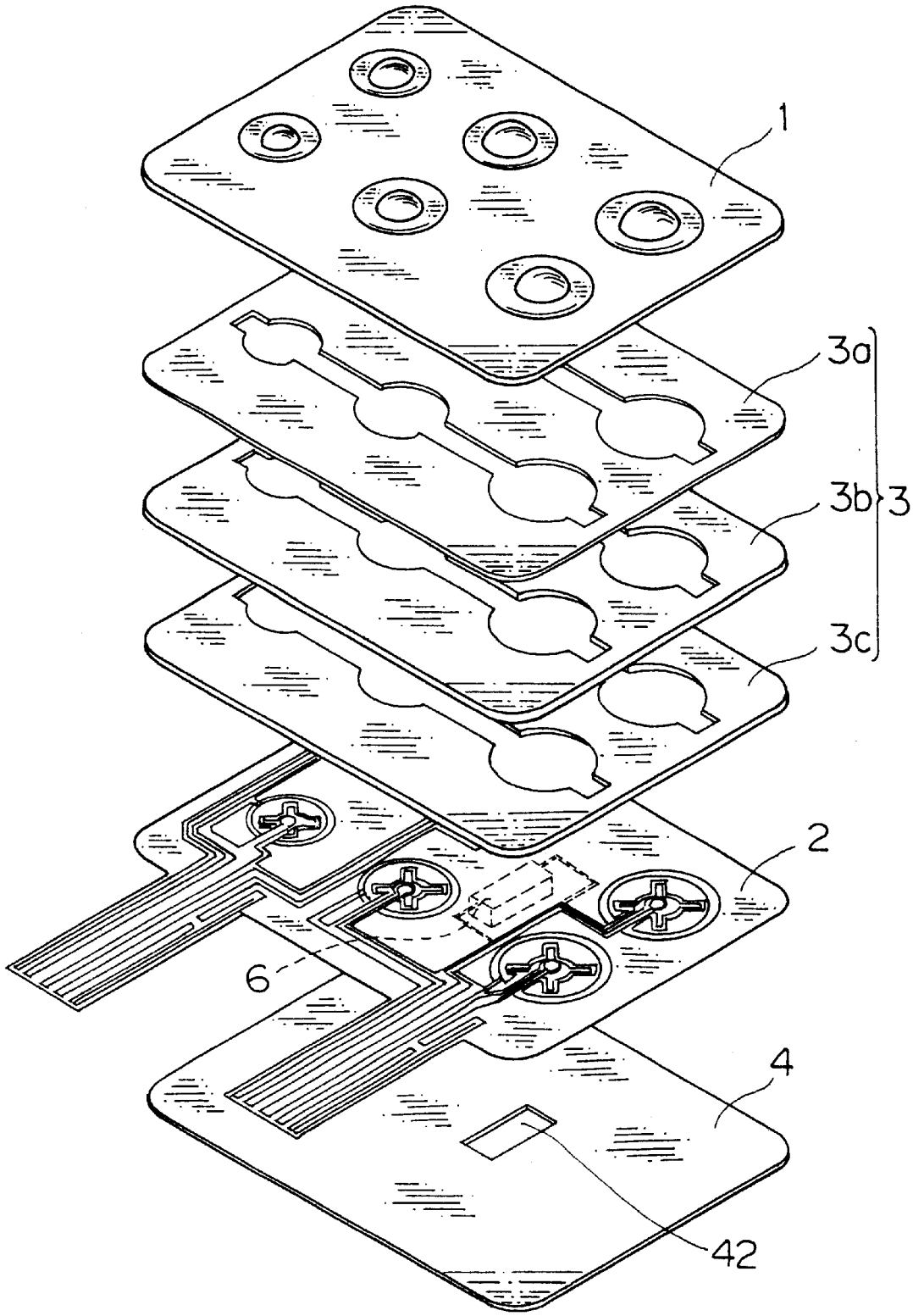
FIG. 7 is an exploded perspective view of an example of a dome switch having chip-type components mounted on a back side of an electric circuit body.

One example of the electric circuit body 2 provided at the back side thereof with chip-type components 6 is shown in FIG. 7 (marks of common parts are the same in FIGS. 5 and 6).

An adhesive layer 4 is provided at a position corresponding to the chip-type components 6 with a chip-type component receiving portion 42. Therefore, the adhesive layer 4 may not be pushed up and deformed by the chip-type components 6 so that operatability and functions of the single switch A are not deteriorated. Providing a receiving portion for receiving the chip-type components 6 on a mounting device (not shown) mounted with the dome switch, relatively tall chip-type components 6 can be mounted without feeling of so tall components existing.

A dome switch according to the invention is operated by an operator's finger (fingertip) generally. Preferably, an operating device having a contacting portion, smaller than a convex portion of a single switch, for actuating the convex portion and an operating portion larger than the convex portion may be provided to improve operatability more when the dome switch is operated by a hand with gloves or other body part because of the relative small convex portion.

Figure 13A:
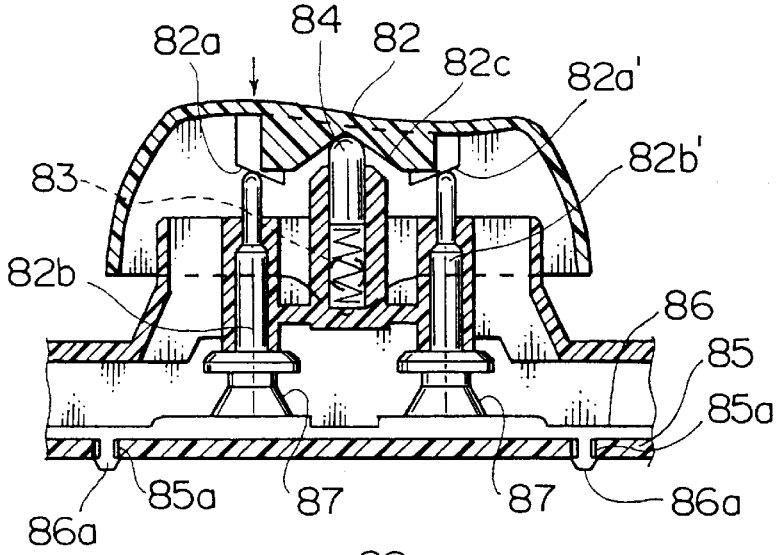
PRIOR ART FIG. 13A
FIG. 13A is a sectional view of the rocker-type combined switch by prior art in FIG. 12, showing a condition before operation.
Figure 13B:
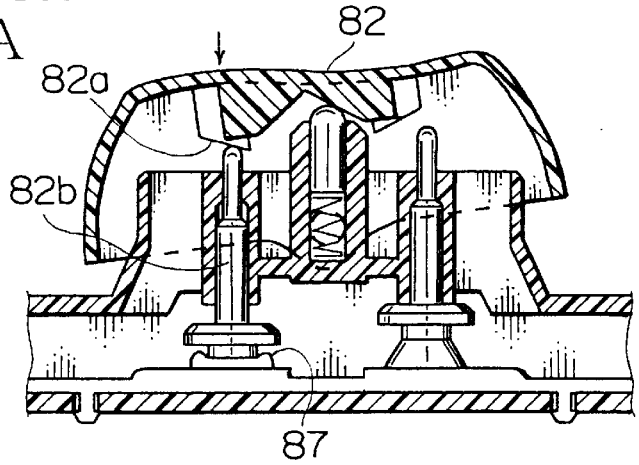
PRIOR ART FIG. 13B
FIG. 13B is a sectional view of the rocker-type combined switch in FIG. 12, showing a first condition of operation.
Figure 13C:
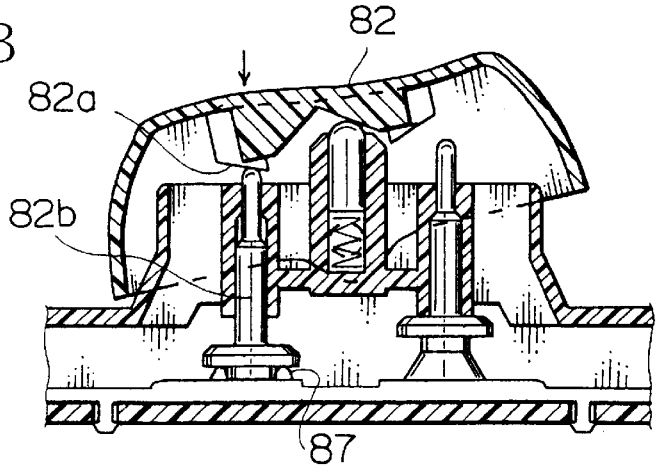
PRIOR ART FIG. 13C
FIG. 13C is a sectional view of the rocker-type combined switch in FIG. 12, showing a second condition of operation.

FIG. 8 shows a sectional view of an example for providing an operating device to give similar operatability as a combined switch (rocker-type combined switch) by prior art shown in FIG. 13.

The rocker switch is provided with rocker-type operating portion 60 having two symmetrical shaped pushing portions 60*a*, 60*a*' at both ends thereof; a rocker fulcrum portion 61 supporting the rocker-type operating portion 60 as a rocker fulcrum; two single switches A, A' (same as single switch A in this example) respectively under two pushing portions 60*a*, 60*a*' and actuating pins 62, 62' for actuating respectively convex portions 1*c*, 1*c*' of two single switches A, A' by rocking motion of the rocker-type operating portion 60. The loading portions 62*a*, 62*a*' of the actuating pins 62, 62' abutting respectively on the convex portions 1*c*, 1*c*' of the single switches A, A' are smaller than each of corresponding convex portions 1*c*, 1*c*' of the single switches A, A' and the pushing portions 60*a*, 60*a*' are larger than the convex portions 1*c*, 1*c*' of the single switches A, A'.

The rocker-type operating portion 60, the rocker fulcrum portion 61 and the actuating pins 62, 62' form an operating device having a contacting portion, smaller than a convex portion of a single switch, for actuating the convex portion and an operating portion larger than the convex portion.

In this example, the actuating pins 62, 62' are separated parts from the rocker-type operating portion 60 and are moved respectively by cams 60*b*, 60*b*' provided at the back side of the rocker-type operating portion 60 to actuate the convex portions 1*c*, 1*c*' of the single switch A in the same direction of the stroke direction. Therefore, extremely secure operation can be done.

The loading portions 62*a* and 62*a*' of the actuating pins 62, 62' are smaller than each of the convex portions 1*c*, 1*c*' of the single switch A. Therefore, concerning malfunction is not required.

The convex portion 1*c* of the single switch A and the convex portion 1*c*' of the single switch A' return securely to a position of turning both single switches A, A' to OFF+OFF (neutral position) shown in FIG. 1A with click feeling when operating load is removed. Therefore, a concave cam, a restraining pin and a spring in a rocker-type combined switch by prior art shown in FIG. 13 are not required in this example.

Figure 8A:
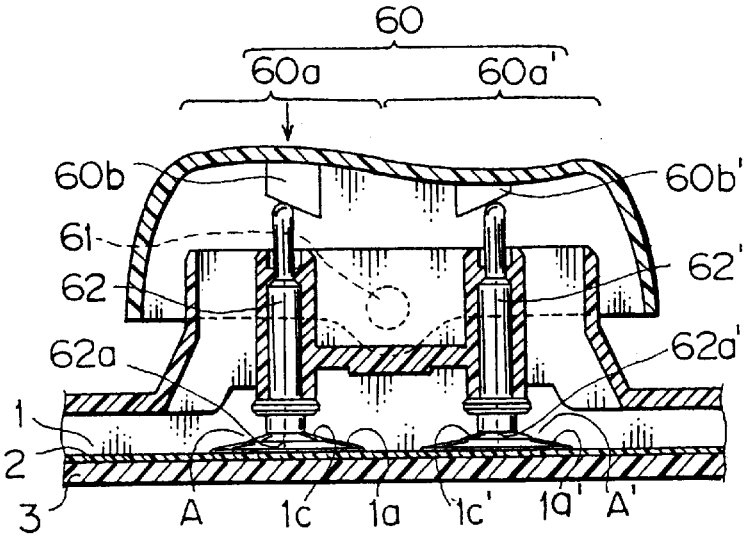
FIG. 8A is a sectional view of an example of a rocker-type combined switch according to the invention, showing a condition before operation.

In the condition before operating of FIG. 8A, the single switch A and single switch A' are both in OFF+OFF condition.

Figure 8B:
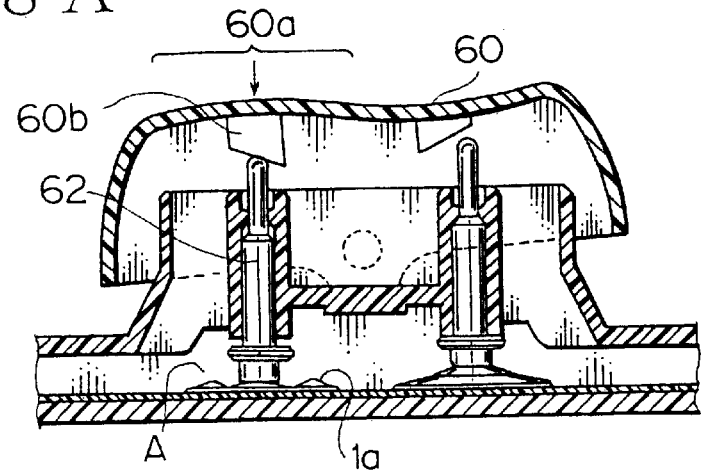
FIG. 8B is a sectional view of the rocker-type combined switch in FIG. 8A, showing a first step condition of operation.

When an operator pushes the pushing portion 60*a*, the rocker-type operating portion 60 sways and the loading portions 62*a* of the actuating pin 62 pushes down the convex portion 1*c* of the single switch A by the cam 60*b* action to be in condition FIG. 8B with click feeling and then the single switch A turns to ON+OFF (the first step).

Figure 8C:
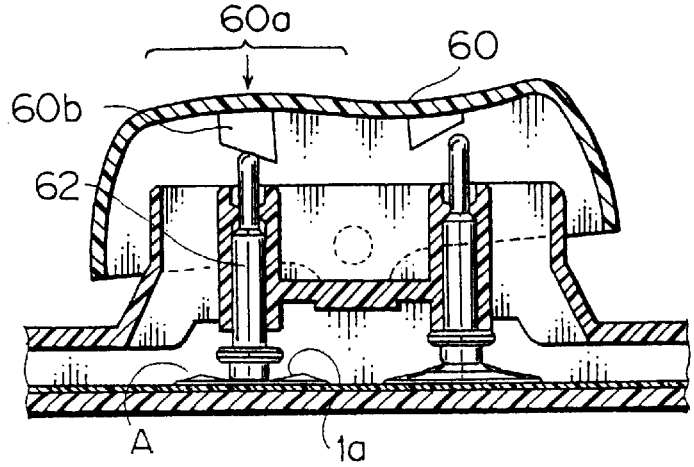
FIG. 8C is a sectional view of the rocker-type combined switch in FIG. 8A, showing a second step condition of operation.

Proceeding the operation, the single switch A goes in FIG. 8C condition with click feeling and turns to ON+ON (the second step).

When an operator removes its finger from the pushing portion 60*a* of the rocker-type operating portion 60, the turned-over domed projection 1*a* and the turned-over domed convex portion 1*c* of the single switch A in any step returns respectively to the condition shown in FIG. 8A.

The example mentioned above shows operation of the pushing portion 60*a* of the rocker-type operating portion 60. When the right side pushing portion 60*a*' is pushed, the single switch A' is operated similarly instead of the single switch A.

Such rocker-type combined switch requires one half numbers of single switch to perform the same operation as the switch by prior art shown in FIG. 13. Therefore, mounting area for switches is smaller and occupied area by electric contacts for switches on an electric circuit body is decreased so that design flexibility becomes better and number of required parts is decreased. Advantageously, the second step operation which is hard to sense in prior art can be sensed easily.

Furthermore, providing an operating device having a contacting portion, smaller than a convex portion of a single switch and an operating portion larger than the convex portion, operatability of switches is extremely improved so that pushing a small convex portion with a fingertip is not required and operation by a hand with gloves or other body part such as a palm of a hand is done easily.

Figure 9:
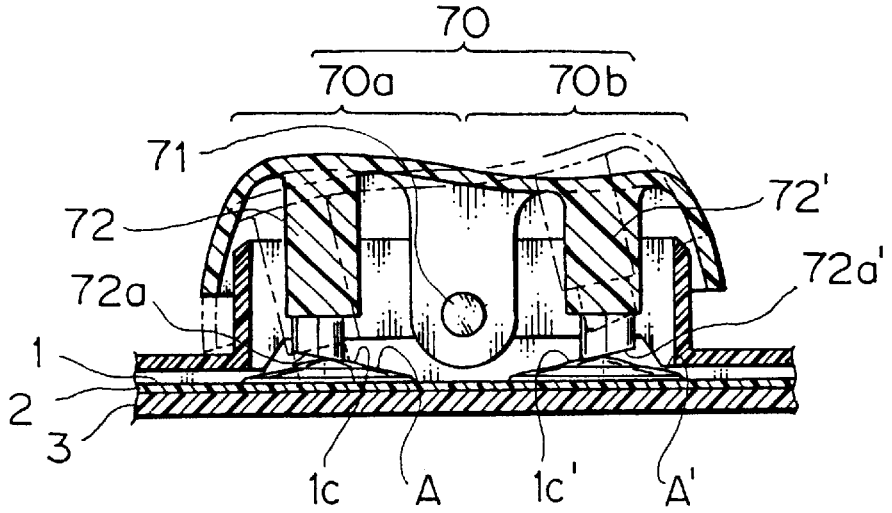
FIG. 9 is a sectional view of other example of a rocker-type combined switch according to the invention.
Figure 12:
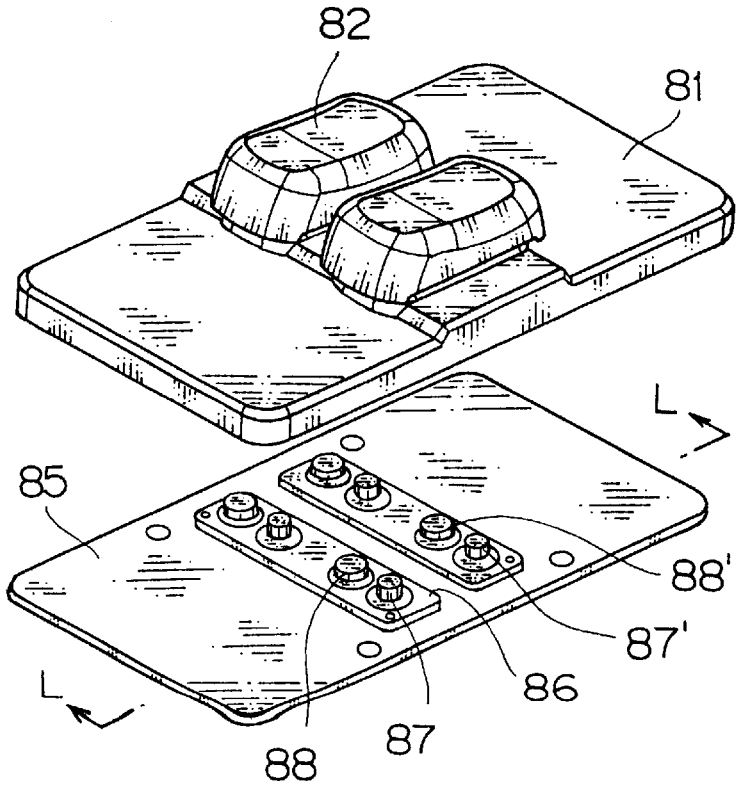
PRIOR ART FIG. 12
FIG. 12 is an exploded perspective view of an example of a rocker-type combined switch by prior art.

An operating stroke of a single switch in a dome switch according to this invention is relatively short. Therefore, number of components can be decreased less than the number of components of the rocker-type combined switch shown in FIG. 8. Such example is shown in FIG. 9.

The rocker switch is provided with rocker-type operating portion 70 having two symmetrical shaped pushing portions 70*a*, 70*a*' at both ends thereof; a rocker fulcrum portion 71 supporting the rocker-type operating portion 70 as a rocker fulcrum; two single switches A, A' (same as single switch A in this example) respectively under two pushing portions 70*a*, 70*a*' and actuating pins 72, 72' for actuating respectively convex portions 1*c*, 1*c*' of two single switches A, A' by rocking motion of the rocker-type operating portion 70. The loading portions 72*a*, 72*a*' of the actuating pins 72, 72' abutting respectively on the convex portions 1*c*, 1*c*' of the single switches A, A' are smaller than each of corresponding convex portions 1*c*, 1*c*' of the single switches A, A' and the pushing portions 70*a*, 70*a*' are larger than the convex portions 1*c*, 1*c*' of the single switches A, A'.

The rocker-type operating portion 70, the rocker fulcrum portion 71 and the actuating pins 72, 72' form an operating device having a contacting portion, smaller than a convex portion of a single switch, for actuating the convex portion and an operating portion larger than the convex portion.

In this example, the actuating pins 72, 72' form a part of the rocker-type operating portion 70 and are moved directly by swaying of the rocker-type operating portion 70 to actuate the convex portions 1*c*, 1*c*' of the single switch A obliquely in a different direction of the stroke direction. However, the loading portions 72*a* and 72*a*' of the actuating pins 72, 72' are smaller than each of the convex portions 1*c*, 1*c*' of the single switch A and the operating stroke of the single switches A, A' is small. Therefore, concerning malfunction is not required.

Although such rocker-type combined switch is operated easily, number of parts therein can be decreased less than that in the combined switch shown in FIG. 8 and a total thickness thereof can be thinner because actuating pins is not required.

Examples of an operating device having a contacting portion, smaller than a convex portion of a single switch, for actuating the convex portion and an operating portion larger than the convex portion are shown with rocker-type combined switches supported by a rocker fulcrum portion in FIGS. 8, 9. This invention is not limited in all above examples. A switch in which an operating device having a contacting portion, smaller than a convex portion of a single switch, for actuating the convex portion and an operating portion larger than the convex portion is mounted by a plastic film or a tubular supporting device to make the contact portion abut on the convex portion is considered in this invention. Although examples mentioned above are to operate respectively each of single switches, one operation can actuate two or more switches simultaneously and it is considered in this invention.

Figure 10A:
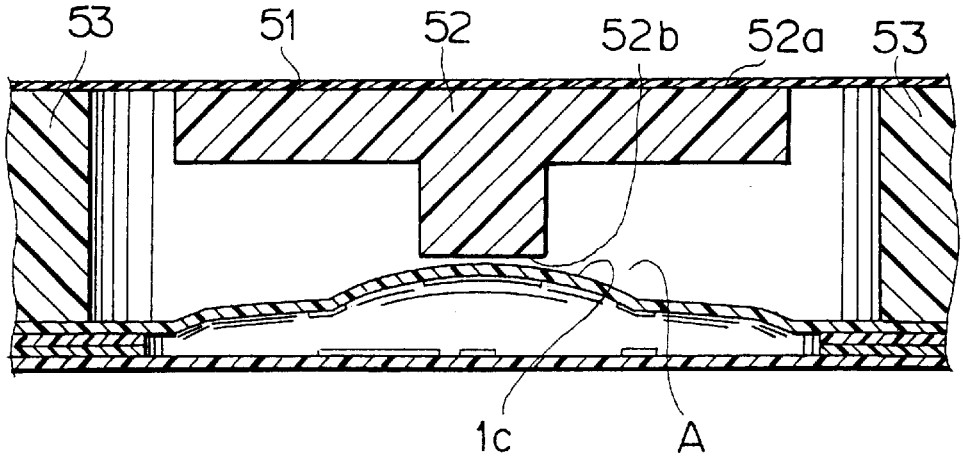
FIG. 10A is a sectional view of an example of an operating device supported by a film for improving operatability of a dome switch according to the invention.

A sectional view of such example, in which an operating device having a contacting portion 52*b*, smaller than a convex portion 1*c* of a single switch A, for actuating the convex portion 1*c* and an operating portion 52*a* larger than the convex portion 1*c* is supported by a film 51 and a spacer 53 to make the contacting portion 52*b* abut on the convex portion 1*c*, is shown in FIG. 10A.

In this example, the operating device 52 can be pushed to push the film 51 covering the operating device 52 because the film 51 is a soft material for operating the single switch A. After operation is finished, the single switch returns to the condition shown in FIG. 10A by turning over of the domed projection 1*a* and the domed convex portion 1*c* of the single switch A without any elastic devices such as a spring. Therefore, number of required parts is small and then high reliable, durable and operatable switch can be given.

Figure 10B:
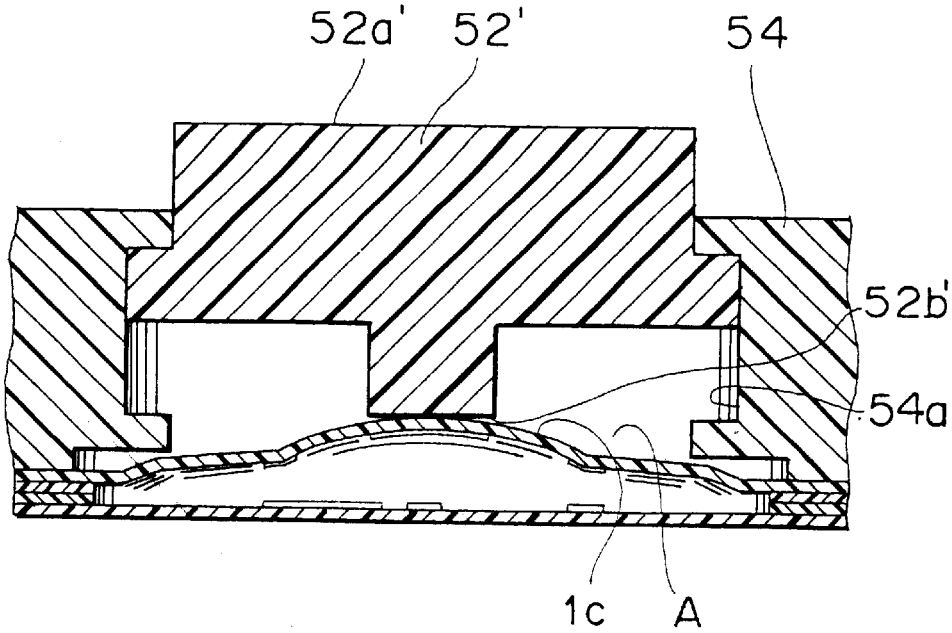
FIG. 10B is a sectional view of an example of an operating device supported by a supporting body for improving operatability of a dome switch according to the invention.

A sectional view of such example, in which an operating device 52' having a contacting portion 52*b*', smaller than a convex portion 1*c* of a single switch A, for actuating the convex portion 1*c* and an operating portion 52*a*' larger than the convex portion 1*c* is supported by a supporting body 54 having a tubular cylinder portion 54*a* to make the contacting portion 52*b*' abut on the convex portion 1*c*, is shown in FIG. 10B.

The operating device 52' is moved up-and-down in the drawing along a wall of the cylinder portion 54*a* by pushing and releasing operation to turn over the domed projection 1*a* and the come-shaped convex portion 1*c* of the single switch A. Therefore, number of required parts is small and then high reliable, durable and operatable switch can be given similarly as the switch in FIG. 10A.

Figure 11:
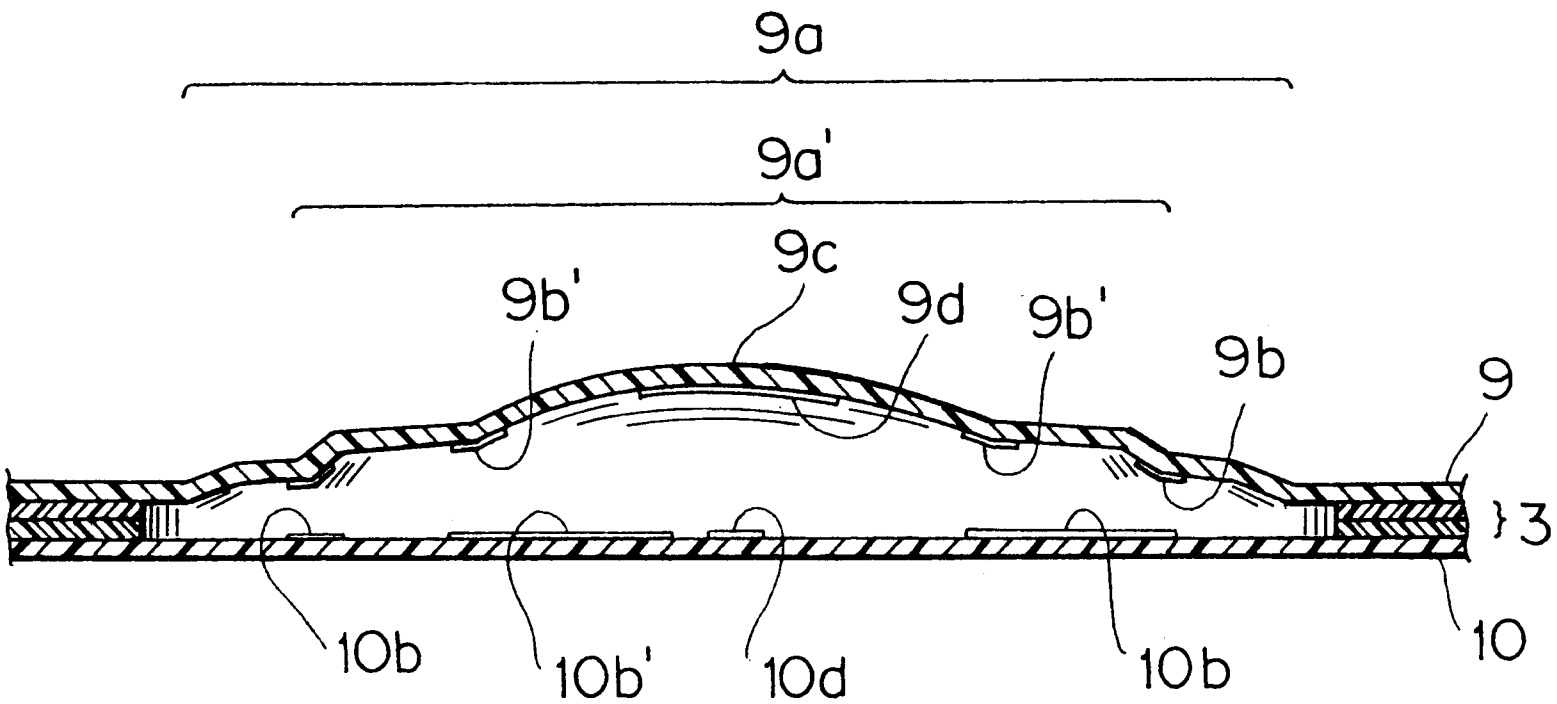
FIG. 11 is a sectional view of an example of a dome switch having a three-step-type single switches A.

A two-step-type single switch is described above. However, a three-step-type single switch shown in FIG. 11 or a single switch having four or more steps can be applied in this invention.

A dome switch according to this invention can be applied preferably to mount on a rocker-type combined switch for operating a power window in a car. The dome switch can be applied to any device which requires two of ON-OFF or more signal status. For example, a switch in a mouse device for a computer to generate a double click signal, a switch instead of switches required to be pushed simultaneously such as a main switch and a shift switch or a control switch, a switch required to be pushed several times and continuously in a mobile phone or a mobile terminal when inputting data in an address book or an electric mail or in any other application may use the dome switch.

What is claimed is:

1. A dome switch including a single switch comprising:

a front sheet having a domed projection projecting outside, being reversible and provided with an electrode at a back side;

an electric circuit body having an electric contact to contact with said electrode provided on said domed projection when said domed projection is reversed; and, a domed convex portion provided in a vicinity of a center of said domed projection, wherein, in a process of pushing said convex portion, said projection is reversed and said electrode provided near a periphery of said convex portion at the back side of said front sheet is brought into contact with said electric contact provided on said electric circuit body and a center electrode provided in a vicinity of a center of said domed convex portion at said back side of said front sheet is brought into contact with said electric contact provided on said electric circuit body.

2. The dome switch according to claim 1, wherein the domed convex portion is reversed to the back side of the front sheet.

3. The dome switch according to claim 1 or 2 comprising a plurality of the single switches.

4. The dome switch according to claim 1 or 2, comprising, between the front sheet and the electric circuit body, a spacer sheet having a throughhole for ensuring contact between said electrode at said back side of said front sheet and the electric contact of said electric circuit body in the single switch for preventing deformation of said front sheet.

5. The dome switch according to claim 4, wherein the spacer sheet functions to provide a stroke distance for the projection and the convex portion.

6. The dome switch according to claim 5, wherein the spacer sheet includes multi-layered sheets with a top layered spacer sheet at the front sheet side being thinner than an under layered spacer sheet for fine adjustment of the stroke distance.

7. The dome switch according to claim 5, wherein a diameter of the throughhole of a top layered spacer sheet is formed larger than or equal to a diameter of the projection, and a diameter of the throughhole of an under layered sheet is formed larger than or equal to said diameter of said throughhole of said top layered sheet.

8. The dome switch according to claim 4, comprising:

a plurality of the single switches;

said spacer sheet being formed in positions corresponding to the plurality of said single switches with said throughholes for ensuring contact between said electrode at said back side of the front sheet and the electric contact of the electric circuit body in each of said single switches to prevent said front sheet from deformation, and located between said front sheet and said electric circuit body; and an air communicating portion for communicating the throughholes in said spacer sheet with each other.

9. The dome switch according to claim 8, wherein the spacer sheet includes multi-layered sheets and the air communicating portion is provided on a spacer sheet other than a top layered spacer sheet at the front sheet side.

10. The dome switch according to claim 8, comprising;

an adhesive layer provided on a rear surface of the electric circuit body for fixing said dome switch on a mounting device; and an air vent through the electric circuit body and the adhesive layer being communicated with the air communicating portion.

11. The dome switch according to claim 4, wherein a light emitting diode is mounted on a front sheet side surface of the electric circuit body, wherein the spacer sheet is provided with a light guide portion for receiving said light emitting diode and guiding a light of the diode to the front sheet, and wherein the front sheet has a light transmissible area which corresponds to said light guide portion and illuminated by the light emitting diode to provide a lighting area.

12. The dome switch according to claim 11, wherein a light diffusing device is provided between the light guiding portion and the lighting area.

13. The dome switch according to any of claim 4, wherein a chip-type component is mounted on a surface of the electric circuit body at the side of the front sheet and the spacer sheet has a chip-type component receiving section for receiving said chip-type component.

14. The dome switch according to claim 13, wherein the front sheet has a separate projection in a location corresponding to the chip-type component receiving section of the spacer sheet.

15. The dome switch according to claim 1 or 2, wherein the electric circuit body is provided, on a rear surface thereof, with an adhesive layer for fixing said dome switch on a mounting device and a chip-type component is mounted on the rear surface of said electric circuit body and said adhesive layer is provided with a chip-type component receiving section corresponding to said chip-type component.

16. The dome switch according to claim 1 or 2, wherein the electric circuit body is provided therethrough with an air vent communicating from a space of the domed projection and the electric circuit body to a rear surface of said electric circuit body.

17. The dome switch according to claim 16, wherein the electric circuit body is provided, on a rear surface thereof, with an adhesive layer having an air vent corresponding to the air vent of said electric circuit body for fixing said dome switch on a mounting device.

18. The dome switch according to claim 1 or 2, comprising an operating device having an loading portion which is smaller than the convex portion of the single switch for pushing the convex portion and an operating portion which is larger than said convex portion.

19. A rocker-type combined switch having two ends comprising:

a rocker-type operating portion having two symmetrical shaped pushing portions at both ends thereof;

a rocker fulcrum portion supporting said rocker-type operating portion as a rocker fulcrum;

a dome switch having at least one of the single switches according to claim 1 or 2 respectively under said two pushing portions; and an actuating pin for actuating a convex portion of each of said at least one of the single switches by rocking motion of said rocker-type operating portion, wherein a loading portion of said actuating pin, abutting respectively on each convex portion of said at least one of the single switches, is smaller than each corresponding convex portion of said at least one of the single switches and said pushing portions are larger than convex portions of said at least one of the single switches.

20. The rocker-type combined switch according to claim 19, wherein moving direction of the actuating pin for pushing a convex portion of a single switch is the same direction as a stroke direction of said convex portion of said single switch.

* * * * *